US006622628B2

(12) United States Patent
Fisher et al.

(10) Patent No.: US 6,622,628 B2
(45) Date of Patent: Sep. 23, 2003

(54) METHOD OF CONTROLLING THE INITIATION OF A SMART IGNITER

(75) Inventors: John C. Fisher, Lutz, FL (US); James W. Griggs, III, Bradenton, FL (US); James Sowers, Lakeland, FL (US); Timothy Ilyes, Lakeland, FL (US)

(73) Assignee: Breed Automotive Technology, Inc., Lakeland, FL (US)

( * ) Notice: Subject to any disclaimer, the term of this patent is extended or adjusted under 35 U.S.C. 154(b) by 8 days.

(21) Appl. No.: 10/262,975

(22) Filed: Nov. 26, 2002

(65) Prior Publication Data

US 2003/0101888 A1 Jun. 5, 2003

Related U.S. Application Data

(62) Division of application No. 09/934,911, filed on Aug. 22, 2001, now Pat. No. 6,490,976.

(51) Int. Cl.[7] ..... F23Q 7/02
(52) U.S. Cl. ..... 102/215; 102/202.5; 102/206
(58) Field of Search ..... 102/200, 202.5, 102/206, 215; 375/211

(56) References Cited

U.S. PATENT DOCUMENTS

| | | | | | |
|---|---|---|---|---|---|
| 4,145,970 | A | * | 3/1979 | Hedberg et al. | 102/218 |
| 4,374,492 | A | * | 2/1983 | Goldberg et al. | 102/220 |
| 4,670,886 | A | * | 6/1987 | Newcombe et al. | 375/211 |
| 4,712,477 | A | * | 12/1987 | Aikou et al. | 102/206 |
| 4,730,558 | A | * | 3/1988 | Florin et al. | 102/218 |
| 4,796,278 | A | * | 1/1989 | Naka | 375/211 |
| 4,843,964 | A | * | 7/1989 | Bickes et al. | 102/202.5 |
| 5,007,661 | A | * | 4/1991 | Lenzen | 280/735 |
| H1214 | H | | 8/1993 | Liva et al. | 102/201 |
| 5,908,204 | A | * | 6/1999 | Smith | 280/741 |
| 5,957,988 | A | * | 9/1999 | Osajda et al. | 701/45 |
| 6,166,452 | A | * | 12/2000 | Adams et al. | 307/10.1 |
| 6,173,651 | B1 | * | 1/2001 | Pathe et al. | 102/218 |
| 6,275,756 | B1 | * | 8/2001 | Griggs et al. | 701/45 |
| 6,546,873 | B1 | * | 4/2003 | Andrejkovics et al. | 102/200 |
| 2002/0020533 | A1 | | 2/2002 | Tubel | 166/313 |

* cited by examiner

*Primary Examiner*—Michael J. Carone
*Assistant Examiner*—Troy Chambers
(74) *Attorney, Agent, or Firm*—Lonnie Drayer

(57) ABSTRACT

A smart igniter bus system has a repeater connected by a bus to a controller, and one or more smart igniters connected by the bus to the repeater so that the repeater is between the smart igniters and the controller. The repeater receives data transmitted on the bus by the controller and processes the signal sent by the controller with onboard logic. Utilizing the onboard logic, the repeaters are preprogrammed to rebroadcast control signals sent by the controller or to only rebroadcast selected signals, or to generate and transmit new command signals.

3 Claims, 3 Drawing Sheets

METHOD OF CONTROLLING THE INITIATION OF A SMART IGNITER

This is a Divisional of patent application Ser. No. 09/934,911 filed Aug. 22, 2001 now U.S. Pat. No. 6,490,976.

BACKGROUND OF THE INVENTION

The present invention relates to smart igniter detonators in general and to systems for communicating with smart igniter detonators in particular.

A critical factor in the safe use of explosives and pyrotechnic devices is to make the explosive: material or gas generating material relatively insensitive to environmental factors which might initiate an explosion or deflagration. This is normally accomplished by a combination of packaging and choice of reactive materials. The insensitivity of the reactive materials making up the gas generator or the explosive should ideally be extended to the initiation charge as well as the primary charge. This has resulted in the development of initiators in which a nonexplosive material is caused to explode by electrical means. The result is an explosive or gas generator charge that is relatively insensitive to shock, temperature, and even electromagnetic interference.

Classically a so-called hot-wire detonator initiates an explosive charge or gas generator by heating a wire in contact with the initiation charge. Such initiation requires an initiation charge that is relatively sensitive and requires the transmission of a substantial amount of current to the detonator.

Smart igniters are a class of devices which combine a nonthermal igniter, typically a semiconductor bridge igniter with a microprocessor, together with the necessary electrical components for accumulating and discharging an electrical charge to activate the igniter. The microprocessor allows the smart igniter to interface with a databus for transmitting status data, and for receiving a digitally encoded initiation/detonation signal, as explained more fully in U.S. Pat. No. 6,275,756, which is incorporated herein by reference. The advantages of the smart igniter are that: the status of each igniter may be continually monitored, multiple igniters may be electrically connected in parallel by a single pair of wires making up a data bus, and ignition is under computer control by sending a signal to the unique address that allows each smart igniter to be individually controlled.

Using smart igniters places individual igniters on what amounts to a data bus or network which is inevitably subject to the limitations of all data transmission, which is that of the signal transmitted over electrical lines becoming degraded. Where the electrical characteristics of wire transmission lengths exceed hundreds of feet or yards, the result is large values of electrical capacitance and inductance. It is well known that using transmission wire cables with large values of capacitance and inductance creates problems with analog and digital communications including data latency, signal amplitude and power loss, and loss of waveform data pulse shape and timing accuracy and integrity. To gain full advantage of the benefits available through the use of smart igniters, a system of data bus repeaters is needed for use where the transmission of data between smart igniters is degraded by the length of the transmission lines.

SUMMARY OF THE INVENTION

The smart igniter bus system of this invention comprises a controller, a repeater connected by a bus to the controller, and one or more smart igniters connected by the bus to the repeater so that the repeater is between the smart igniters and the controller. The repeater receives data transmitted on the bus by the controller and processes the signal sent by the controller, with onboard logic. Utilizing the onboard logic the repeaters may be preprogrammed to, or may be instructed by the controller, to rebroadcast control signals sent by the controller, to only rebroadcast selected signals, or to generate and transmit new command signals. The repeaters also transmit power downstream of the repeater, for use by subsequent repeaters and the smart igniters.

The repeater thus provides the functionality of receiving and correcting a signal degraded by transmission line properties, the ability to command a greater number of smart igniters by reusing bus addresses, and blocking transmission of signals which are unneeded by the smart igniters which follow the repeater. The repeater also provides functionality between the smart igniters and the controller by receiving signals transmitted from the start igniters and again performing one or more of the functions of: correcting a signal degraded by transmission line properties, adding additional addressing information to a transmitted signal, and preventing retransmission of information unnecessary to be received by the controller.

It is a feature of the present invention to provide a smart igniter system which can function with long data bus transmission lines.

It is another feature of the present invention to provide a smart igniter system which can reduce traffic on some bus segments without reducing functionality.

It is a further feature of the present invention to provide a smart igniter system which can increase the number of smart igniters which can be addressed on a single bus.

Further features and advantages of the invention will be apparent from the following detailed description when taken in conjunction with the accompanying drawings.

DESCRIPTION OF THE PREFERRED EMBODIMENTS

Figure 1:
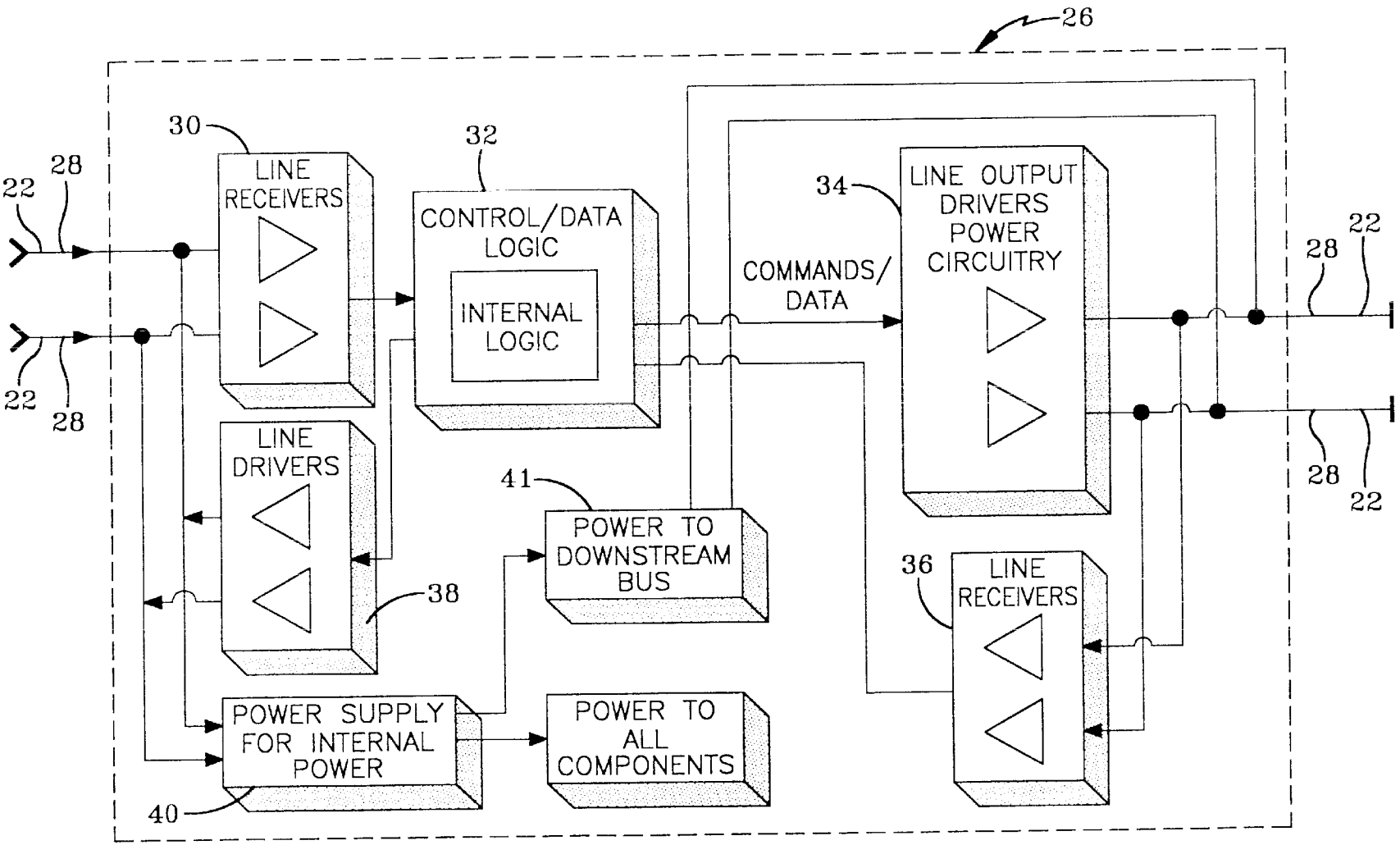
FIG. 1 is a top-level block diagram of the smart igniter communications repeater of this invention.
Figure 2:
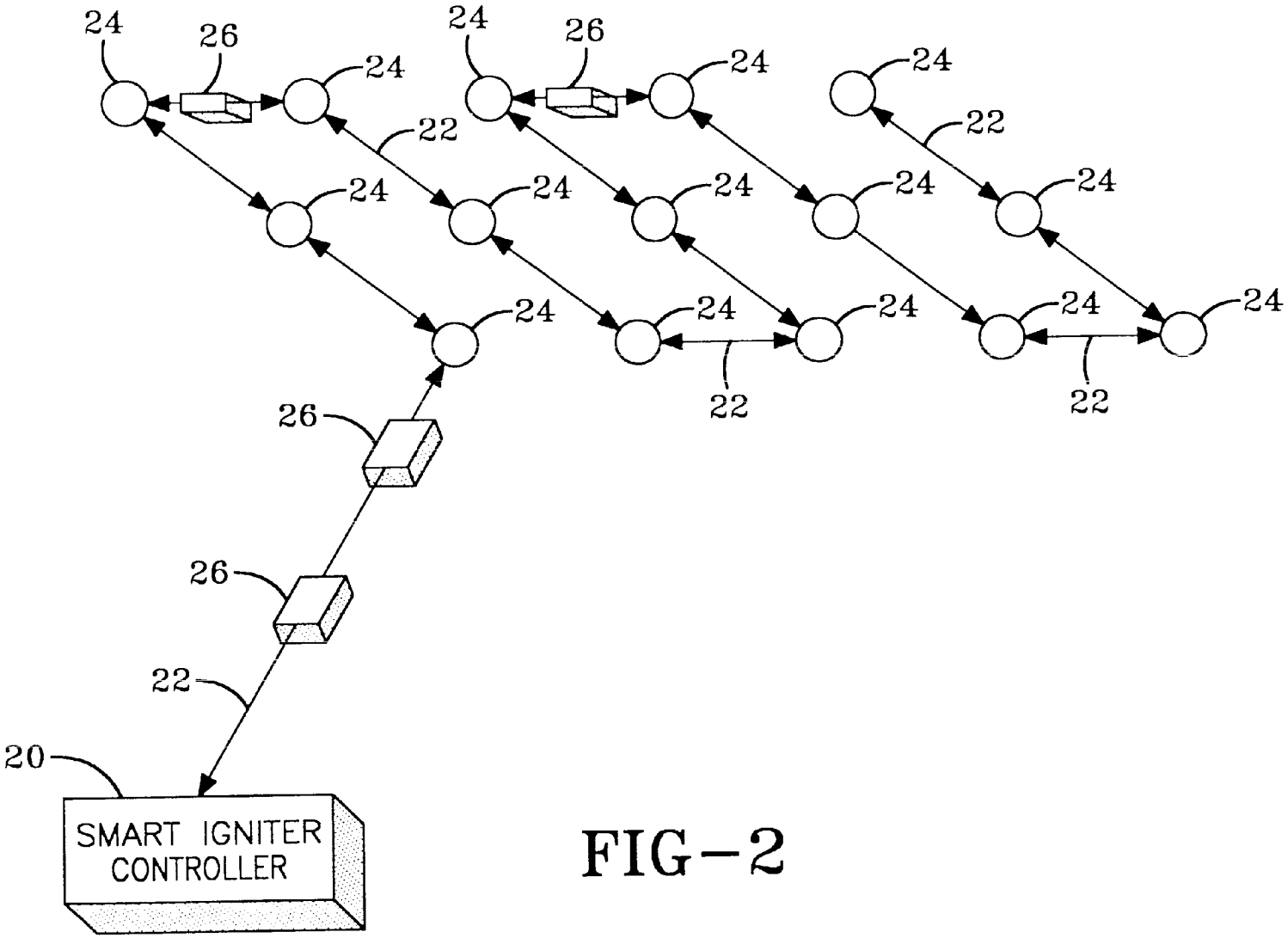
FIG. 2 is an illustrative view of the use of smart igniters with the repeaters of this invention in a mining application.
Figure 3:
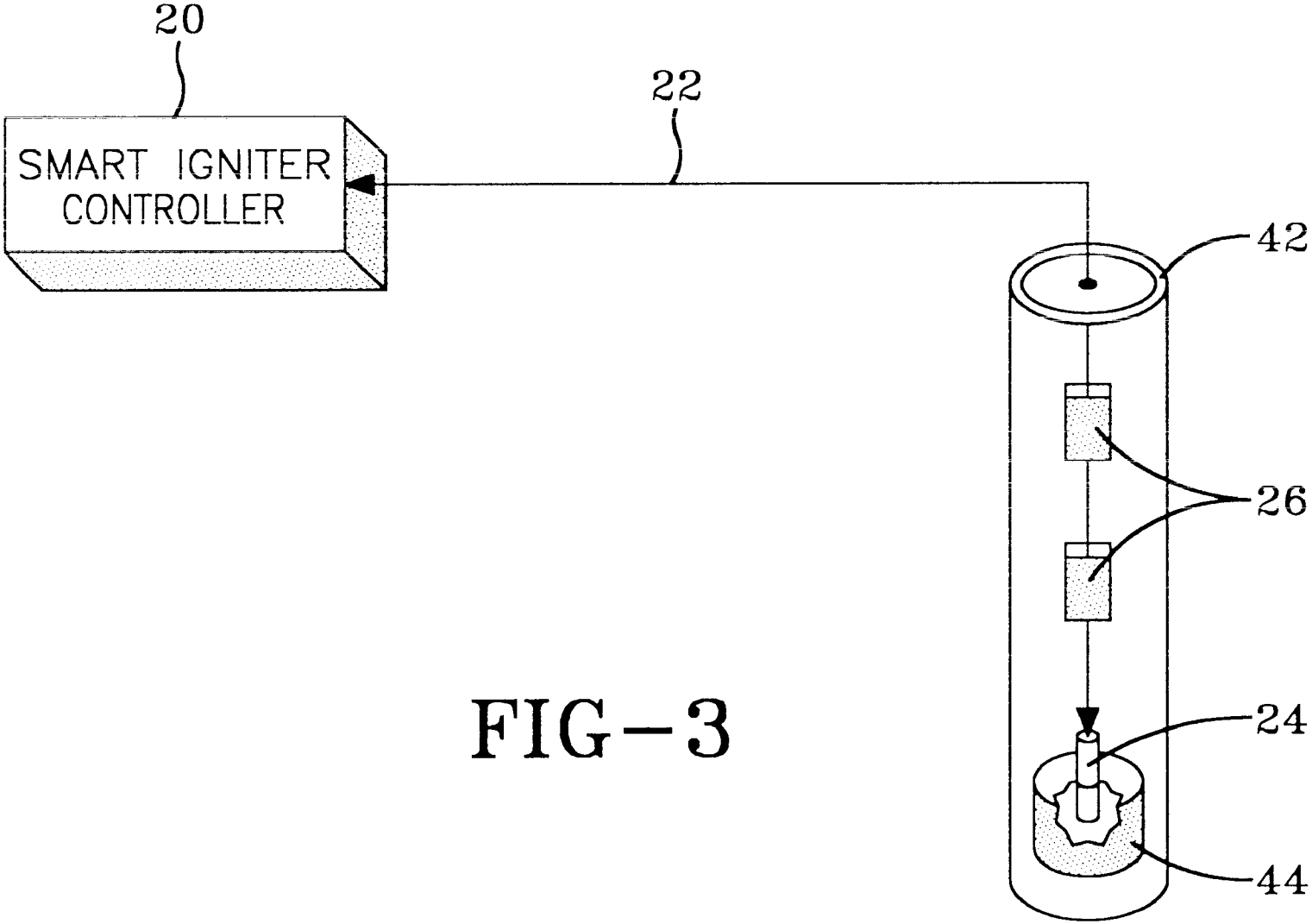
FIG. 3 is an illustrative view of the use of smart igniters with the repeater of this invention in a seismic bore hole.

Referring more particularly to FIGS. 1–3 wherein like numbers refer to similar parts, a smart igniter controller 20 is shown in FIGS. 2 and 3. The smart igniter controller 20 communicates over a bus 22 with a plurality of smart igniters 24. The smart igniters may be used, for example, for activating a pyrotechnic driven vehicle safety device such as an airbag or seat belt pretensioner, or for initiating an explosive device using an electronic detonator for mining or demolition operations. Periodically the signals sent by the smart controller 20 are received and rebroadcast by repeaters 26 which are situated on the bus between the smart controller and one or more downstream smart igniters 24.

Historically in the mining industry hotwire initiators have had a cost advantage over more advanced technology igniters such as exploding bridge wire igniters, or exploding foil igniters. In many industries, particularly mining, cost is an overriding consideration, and the greater precision in timing and greater safety in initiation of advanced initiators has been too costly for advanced initiators to find widespread use in the mining industry. Recently, smart igniter modules have been designed by companies such as Siemens Automotive to improve the functionality of the igniter systems used in automotive applications such as air bag inflation. These igniters have a solid-state igniter that provide non-thermal initiation of an explosive, or gas generating reaction. The so-called smart igniter developed by Siemens has a simple four-bit address, an onboard processor, together with storage capacitance. The smart igniter can draw power from the bus to charge storage capacitors and can communicate status to the smart igniter controller, and then initiate a detonation, gas generator or other device upon command from the smart igniter controller.

With more than 15 million cars being sold each year in the United States alone and with each car potentially using multiple initiators it is evident that the size of the market for smart igniters may be sufficiently large that they will become cost competitive with hotwire initiators. To meet the needs of the mining industry, certain problems with using smart igniters in non-automotive applications need to be overcome. The problems which need to be addressed are the longer bus wires which result in signal degradation, and the larger number of smart igniters which it is desirable to place on a single bus and problems arising from excessive bus traffic. The solution to problems raised by mining applications of smart igniters, in turn has functionality which may be beneficial in automotive applications as well as in such diverse applications as seismic testing.

The solution to the problems inherent in wider application of smart igniters is the repeater 26 illustrated in the top-level block diagram of FIG. 1.

The repeater 26 is connected to two wires 28 making up the bus 22 over which data from the smart igniter controller 20 is transmitted. The repeater 26 has analog transmission line receiver circuits 30 that perform the function of detecting the high and low voltage transitions that are used to encode information on the bus 22. The line receiver circuits 30 are connected in data transmitting relation to a microprocessor 32 on which a logic program operates. The microprocessor 32 is in turn connected in data sending relation to an analog transmission line output driver circuitry 34 which converts commands and data sent by the microprocessor into the voltage levels and frequencies which are used to transmit data on the bus 22.

The output driver circuits 34 are in turn connected to the wires 28 making up the bus 22. The repeater 26 works in both directions, repeating instructions and data communicated from the smart igniter controller 20, downstream on the bus 22, and detecting, repeating, amplifying, and processing data and commands from downstream repeaters 26 and smart igniters 24. To accomplish the upstream dataflow, downstream analog transmission line receiver circuits 36 are employed to detect the high and low voltage transitions that are used to code information on the bus 22. The downstream line receiver circuits 36 are connected in data transmitting relation to the microprocessor 32, the microprocessor 32 in turn is connected to upstream analog transmission line driver circuits 38 which convert commands and data sent by the microprocessor 32.

A power supply 40 is connected across the upstream wires 28 of the bus 22, and draws power from the bus 22. The bus wires 28 typically carry a DC current, for use by the smart igniters 24. This DC current is used by the power supply 40 to generate the required power and voltages necessary to drive the various components within the repeater 26 as shown in FIG. 1. Typically, the line receivers 30, 36 and the output line drivers 34, 38, and the microprocessor 32 will be designed to operate at a common voltage, but it should be understood that the power supply 40 could be designed to supply different power requirements to different components. As shown in FIG. 1, the power supply 40 also provides power 41 to the downstream wires 28 of the bus 22 to supply energy to the repeaters and smart igniters downstream.

The components making up the smart igniter repeaters 26, including the line receivers 30, 36, the line drivers 34, 38, and the microprocessor 32, are conventional, and their selection and design well understood by those skilled in the art. It should be understood that various design strategies where the various components may be incorporated into a single chip, or may consist of the chips set, the components may be custom-designed or off-the-shelf components, with the power supply typically requiring discrete components, such as capacitive or inductive components.

It should also be understood that the microprocessor 32, may be programmable, and may employ various types of memory including RAM and ROM. In the most basic configuration, the microprocessor 32 simply acts to receive data, and to rebroadcast data, both upstream and downstream on the databus 22, thereby functioning as a simple data bus repeater. The microprocessor 32 may also perform more advanced functions such as data correction based on redundant encoding of data on the bus. The microprocessor 32 may also be programmed to address instructions to specific smart igniters 24. Thus if the smart igniters by design are limited to a 4-bit address, which provides only 16 unique addresses the smart igniter controller 20, and arrangement as shown in FIG. 2, can be used to address an arbitrarily large number of smart igniters where there are no more smart igniters between repeaters than there are unique smart igniter addresses.

Instructions to a particular smart igniter 24 are sent to the repeater 26 immediately upstream of the smart igniter, wherein that repeater is instructed to append the appropriate igniter address and rebroadcast the instruction downstream. Downstream repeaters are instructed not to repeat instructions that have already received an igniter address. Thus an instruction for a particular smart igniter 24 travels down the bus 22 until it reaches the last repeater 26 upstream of that smart igniter 24, which converts the encoded instruction into an instruction which is addressed to that smart igniter 24. Smart igniters with the same address, which are downstream of the next repeater 26, do not receive the instruction because the next repeater 26 is programmed not to rebroadcast instructions that are already addressed.

To perform the foregoing function each repeater must be assigned a unique address so that the smart igniter controller can address instructions directly to it. The smart igniter repeaters 26 can be generally preprogrammed or instructed by the smart igniter controller 20 not to repeat certain types of data. For example where addresses are being reused, the repeaters 26 are programmed not to repeat addressed instructions. Similarly the repeaters may be programmed not to repeat bus communications which are not identified to be repeated. Further when the smart igniter controller 20 is used to check the status of a large number of smart igniters 24, upstream repeaters could be programmed to repeat messages from smart igniters 24, only if an error code is received from a particular igniter, and to generate an error code, if the downstream igniter 24 does not respond to a smart igniter controller instruction. Further a single code indicating all downstream smart igniters have responded correctly to the inquiry could be generated and affirmed by each repeater 26 along the bus 22, so that the smart igniter controller 20 would receive a single code in response to a general inquiry of all smart igniters, if there are no errors to report. Thus it will be understood by those skilled in the art, how to use the intelligence contained in the microprocessor 32 on board the repeaters 26 to reduce bus traffic.

FIG. 3 shows repeaters 26 which may be used sequentially without any smart igniters between them over very long wire lengths, such as is used in a borehole 42. A pyrotechnic charge 44 may be used in seismographic testing where multiple charges may be strung out along the length of a borehole which may be several miles deep, or alternatively explosive charges can be used to penetrate the casing of a borehole, to take a sample, or produce oil or gas.

When used in a mining operation, such as shown in FIG. 2, an array of explosive packed brothels is used to break rock, sometimes in the open pit mining bench, sometimes in an underground heading, but in either instance the charges may be initiated from a relatively great distance, and multiple charges ma y be used in a single borehole, with a large number of boreholes being detonated more or less simultaneously. Typically, timing of the detonations is varied over a small interval of time to allow one body of rock to break before another portion of rock in order to optimize the amount of rock broken and the size and shape of the opening created. The advantages in the blasting industry of a pyrotechnic initiation system with the flexibility available through a combination of a smart igniter, smart igniter repeaters, and smart igniter controller, where all the components are connected by a two-wire bus, is evident.

It should be understood that the line receivers 30, 36 may have the functionality to detect any analog signals, for example by incorporating A/D converters, thus allowing analog signals to be detected and send to the microprocessor 32. The microprocessor 32 could then command D/A incorporated in the line drivers 34, 38, to send an amplified analog signal. Alternatively, the analog signal could be separated by a bandpass filter, amplified and retransmitted, without conversion to digital signal. In this way the same bus system could incorporate other components and their information and data transfer needs.

As used herein and in the claims, the terms "smart igniter" and "smart igniters" are understood to mean pyrotechnic igniters that can be electrically connected in parallel each with an address which allows each smart igniter to have individual control, communication or status interrogation. Smart igniter addresses may be reused, as previously explained for the additional functionality of the repeaters 26.

The electronic microprocessor 32 may be an Application-Specific Integrated Circuit, general-purpose microprocessor, controller or computer, and typically will employ one or more types of memory such as for example flash memory, EPOM, EEPROM, PROM, ROM, static random access memory (RAM), or dynamic RAM.

It should be understood that the bus 22 may be considered as a single bus which extends from the smart igniter controller 20 to the most distant smart igniter 24. At the same time, each repeater 26 effectively creates a new bus, because each time a repeater 26 is interposed along the wires 28, signals, and power, are propagated only by way of the repeater 26, and thus the wires 28 and the bus 22 is interrupted by the repeater 26 through which all signals are processed.

It is understood that the invention is not limited to the particular construction and arrangement of parts herein illustrated and described, but embraces all such modified forms thereof as come within the scope of the following claims.

We claim:

1. A method of controlling the initiation of a smart igniter comprising the steps of:

sending an encoded initiation signal and address, which is incapable of causing initiation of a smart igniter while encoded, along a communication bus;

receiving with a microprocessor said encoded initiation signal and address at a repeater, located on the communication bus;

decoding said initiation signal and address within the repeater, to create a decoded initiation signal and address, which is capable of causing initiation of the smart igniter;

sending the decoded initiation signal and address along a further communication bus on which on which the smart igniter is positioned; and receiving said initiation signal at the smart igniter to which the initiation signal was addressed, and initiating the smart igniter.

2. The method of claim 1 wherein a multiplicity of smart igniters are arranged along a plurality of further communication buses separated by repeaters, and wherein said multiplicity of smart igniters includes igniters having identical addresses, wherein igniters having identical addresses are separated by at least one repeater of said repeaters;

a smart igniter controller performing the step of sending encoded initiation signals and addresses, addressed to a repeater immediately upstream of the smart igniter to be initiated;

the repeater immediately upstream decoding said initiation signal and address, within the repeater, creating a decoded initiation signal and address, which is capable of causing initiation of the smart igniter; sending the decoded initiation signal and address, along the further communication bus on which is positioned the smart igniter; and receiving said initiation signal at the smart igniter to which the initiation signal was addressed, and initiating the smart igniter.

3. A method of controlling the initiation of a smart igniter comprising the steps of:

sending a signal addressed to one of a plurality of repeaters along a communication bus;

receiving said signal at the one repeater, decoding said signal within the one repeater with a microprocessor, to produce an ignition signal and a smart igniter address;

transmitting send ignition signal and address signal downstream; and receiving said signal at said one of said plurality of smart igniters to which the signal was addressed.

* * * * *